United States Patent [19]

Bührer

[11] 4,203,484

[45] May 20, 1980

[54] FOUNDRY MOLDING MACHINE FOR THE PRODUCTION OF MOLD HALVES IN MOLD BOXES

[76] Inventor: Erwin Bührer, Vögelingässchen 40, 8200 Schaffhausen, Switzerland

[21] Appl. No.: 924,250

[22] Filed: Jul. 13, 1978

[30] Foreign Application Priority Data

Jul. 22, 1977 [CH] Switzerland ..... 9108/77

[51] Int. Cl.[2] ..... B22C 17/00

[52] U.S. Cl. ..... 164/227; 164/213

[58] Field of Search ..... 164/18, 24, 27, 29, 164/40, 180, 181, 187, 194, 210, 213, 227; 254/89 H, 93 R

[56] References Cited

U.S. PATENT DOCUMENTS 1,567,203 12/1925 Steinkamper ..... 254/93 R

FOREIGN PATENT DOCUMENTS 2529982 2/1976 Fed. Rep. of Germany ..... 164/213
534635 10/1955 Italy ..... 164/210
42-13178 11/1967 Japan ..... 164/181
50-38371 12/1975 Japan ..... 164/180
728278 4/1955 United Kingdom ..... 164/210

*Primary Examiner*—Robert D. Baldwin
*Attorney, Agent, or Firm*—Toren, McGeady and Stanger

[57] ABSTRACT

A foundry molding machine for producing mold halves in mold forming assemblies which include a pattern device and mold boxes and operates to separate the formed mold halves from the pattern device through operation of a generally vertically extending main cylinder which includes a piston rod having an extension thereon. The extension includes clamping levers which are arranged in pairs to hold the mold boxes in clamped engagement. At least one auxiliary cylinder is arranged in generally parallel relationship with the main cylinder and is located in a laterally spaced arrangement relative thereto for operation on the opposite side of the clamped mold box. The auxiliary cylinder is operatively associated with the main cylinder to be simultaneously supplied with pressure medium from a common source and acts on the extension to provide support during separation of the mold members from the pattern device.

6 Claims, 6 Drawing Figures

FOUNDRY MOLDING MACHINE FOR THE PRODUCTION OF MOLD HALVES IN MOLD BOXES

BACKGROUND OF THE INVENTION

The present invention relates generally to foundry equipment and more particularly to a foundry molding machine for the production of mold halves in mold boxes. The invention particularly relates to a device for separating the mold halves from the pattern devices utilized in the production of the mold halves. The device to which the invention relates is of the type having a generally vertically extending cylinder including a piston rod which carries an extension connected to the piston rod and which is guided so that it may be raised and lowered whereby clamping devices on the extension may operate to engage in clamping relationship the mold boxes.

In the prior art there are known lifting and turning devices of a type which will deliver mold boxes to a molding machine and which will convey finished mold halves away from the machine. In such devices, the mold halves are usually lifted off the pattern devices in the formation of the mold halves.

Although devices of this type generally operate with reliability, in certain cases damage occurs when the mold member or mold half being formed is lifted from the pattern device. Generally, it has been found that the damage which occurs results mainly in pattern devices which are relatively insignificantly tapered and when the production process involves the production of molds with sand bales. Essentially, the invention is directed toward providing an approach which will enable operation of the lifting and turning device in a manner whereby during lifting of the mold halves relative movements between the mold boxes and the pattern devices which do not occur in a direction perpendicular to the plane of the pattern will be prevented or avoided. The invention thus seeks to enable more stable movement of the mold half off the pattern device with relative movement of the mold half occurring in a direction perpendicular to the plane of the pattern device until the mold half has been completely released from the pattern device.

SUMMARY OF THE INVENTION

The present invention may be described as a foundry molding machine for producing mold members in mold forming assemblies which include a pattern device and mold boxes, with the machine comprising means for separating mold members from the pattern device, the separating means including a generally vertically extending main cylinder having a piston rod operable to be raised and lowered by operation of the main cylinder. An extension member is connected to the piston rod and clamping means including clamping levers arranged in pairs on the extension member operate to hold the molding boxes in clamped engagement during release of the pattern device. The invention particularly provides at least one auxiliary cylinder arranged in a generally parallel relationship with the main cylinder and located in a laterally spaced relationship therewith on an opposite side of the mold members, the auxiliary cylinder being associated to operate with the main cylinder for acting on the extension means to provide support during separation of the mold members from the pattern device.

Thus, by virtue of the present invention, at least one second or auxiliary cylinder is arranged in generally parallel relationship to the main or first cylinder and spaced a distance therefrom with the second cylinder being located to act on the extension means on the side of the mold member or mold half opposite the first cylinder. The first and second cylinders are preferably operated by the same type of pressure medium and are advantageously connected to a common source of pressure medium and due to the fact that short feed lines controlled by a joint valve may be provided for the cylinders, pressure variations in the feed line will not create a damaging influence.

If two clamping devices are each arranged on two oppositely located sides of the mold box, the clamping forces applied may be smaller and may simultaneously make it possible to allow the clamping levers of the clamping devices to act at end faces of the mold box on a portion which is constructed as a prismatic bar. Thus, the mold bar is not elastically deformed when it is being grasped during operative movement of the apparatus.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
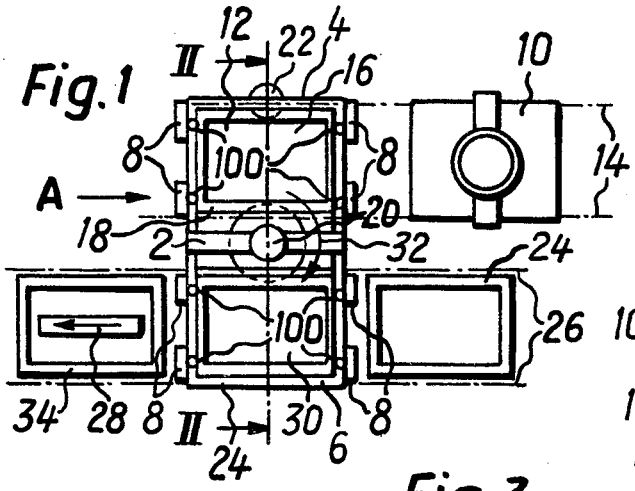
FIG. 1 is a schematic representation showing in plan view a molding machine including a lifting and turning device and conveyor means for delivering and carrying away mold boxes or mold halves.

Referring now to FIG. 1, a lifting and turning device 2 includes clamping devices 8 with two such clamping devices being arranged each on each side of extension members 4 and 6. The extension members 4 and 6 are generally formed in the shape of a frame.

The system includes a molding unit 10 and a position 12 at which a mold forming assembly, which includes a pattern device 16 and a mold box or mold half 18 operatively associated with the pattern device, may be filled with mold forming material. The mold half 18 is conveyed between the position 12 and the molding unit 10 by means of a conveyor device 14.

As shown in FIG. 1, a first or main cylinder means 20 and a second or auxiliary cylinder means 22 are provided. On a conveyor device 26, mold boxes 24 and mold halves 34 are moved in a fixed-cycle type of operation in the direction of an arrow 28.

Clamping devices 8 operate to grasp the mold boxes 24 in the position 30 and the mold halves in the position 12. Mold boxes 24 and the mold halves 18 may be lifted by the lifting and turning device 2 and they may be turned through a half turn in the direction of arrow 32 by operation of the device 2. Subsequently, by lowering the lifting and turning device 2, a mold box 24 in the position 12 can be lowered onto the pattern device 16 and a mold half 18 in the position 30 can be lowered onto the conveyor device 26.

Figure 3:
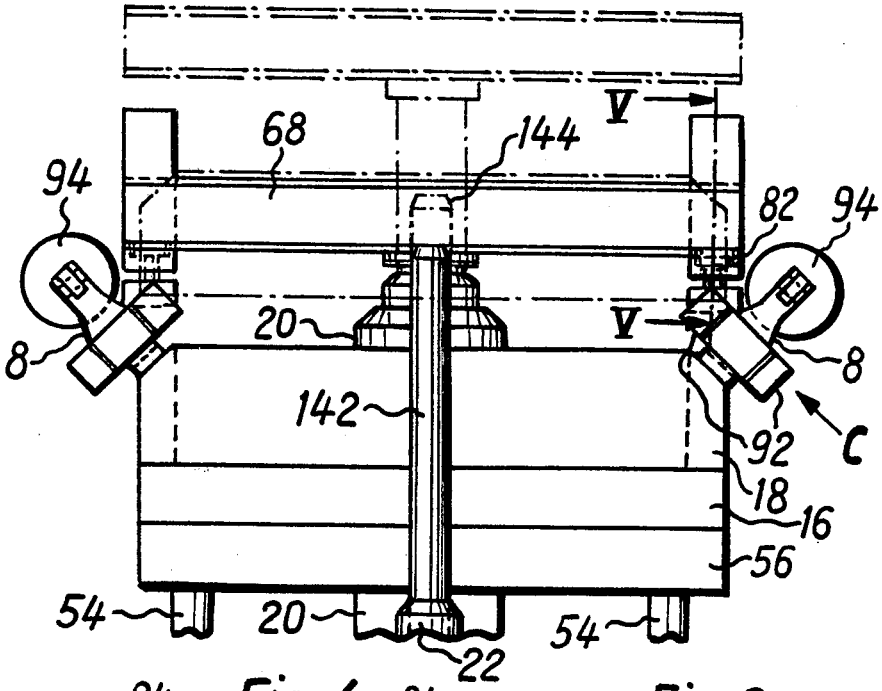
FIG. 3 is a schematic elevational view of the apparatus shown in FIG. 2 taken in the direction of the arrow B.
Figure 2A:
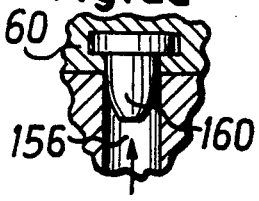
FIG. 2*a* is a partial sectional view taken along the line IIa—IIa of FIG. 2.
Figure 2:
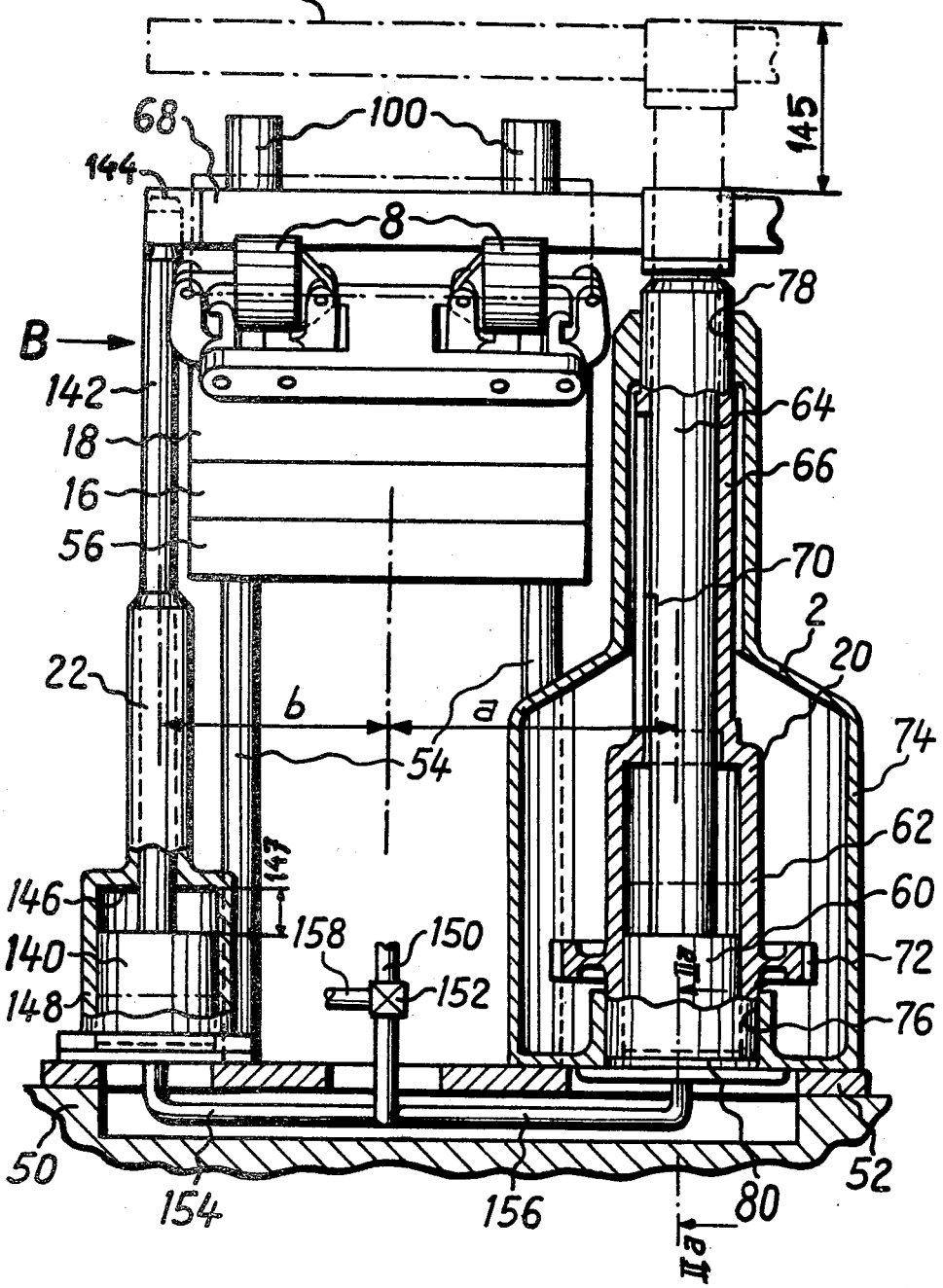
FIG. 2 is a sectional elevation taken in the direction of the arrow A of FIG. 1 along the line II—II of FIG. 1.

After all clamping devices 8 have been opened, the lifting and turning device 2 can be lifted. In the position 12, molding sand is filled into the pattern device 16 which has a mold box 24 placed thereupon. Subsequently, the pattern device 16 is moved into the molding unit 10 by means of the conveyor device 14. Here, the mold forming material is compacted and the compacted mold unit or member is again moved back into the position 12. Simultaneously, mold boxes 24 and the mold halves 18 and 34 which have been placed on the conveyor device 26 are moved through a predetermined distance in the direction of arrow 28. Thereafter, a new cycle of operation may be commenced. As best seen in FIGS. 2 and 3, the cylinder means 20 and the second or auxiliary cylinder means 22 are supported upon a base plate 52 which is, in turn, supported upon a foundation 50. Through columns 54, the base plate 52 carries a support 56, the pattern device 16 and a mold half 18. A piston 60 including a piston rod 64 of the lifting and turning device 2 is connected to an extension 68 and is guided in a cylinder 62 and in guideways 66 in a manner enabling raising and lowering thereof. The piston rod 64 is secured against rotation relative to the guideways 66 by means of a key 70. Through the guideways 66 and the piston rod 64, a gear 72 turns with reciprocating motion the extensions 68,4 and 6 by a half turn in the direction of arrow 32 (see FIG. 1). The apparatus includes drive means (not shown) operatively engaging the gear 72. The cylinder 62 is held in a bearing 76 and the guideways 66 are held in a bearing 78. The rotatable parts are supported on a surface 80.

Figure 4:
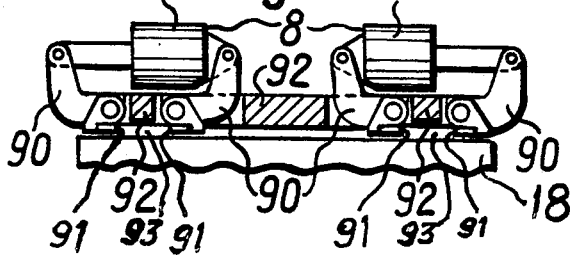
FIG. 4 is a partial sectional view showing clamping devices of the apparatus and taken in the direction of an arrow C in FIG. 3.

Clamping levers 90 of the clamping devices 8 are actuated by cylinders 94 which are pivoted to the clamping levers 90 which operate in pairs (FIG. 4). Clamping surfaces 91 are constructed as end faces of rod-shaped mold box portions 93. The design depicted has the advantage that the clamping forces, which may be on the magnitude of ten tons or more, will not noticeably elastically deform the mold box of the mold half 18. inasmuch as the forces which are applied are exclusively absorbed by the rod-shaped parts 93. Two clamping devices 8 arranged on the same side of the mold box are supported in a joint part 92 through their clamping levers 90. The arrangement of two clamping devices 8 each on a side of the mold box 24 or the mold half 18 makes it possible to maintain the length of the mold box parts 93 relatively small and to arrange the latter near the corners of the mold box whereby the mold box is not deformed as a result of torsional forces which may occur during the process of separation.

Figure 5:
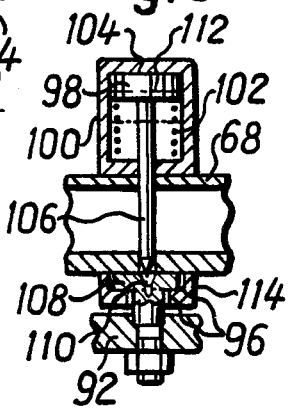
FIG. 5 is a partial sectional view taken along the lines V—V of FIG. 3.

Each of two pins 108 which include flange-like ends are arranged below the cylinder 100 (FIGS. 1 and 5) and operate to support the part 92 in a flange bearing 114 without play in the vertical direction and with the ability to move in the horizontal direction within a degree of play 96. The flanged bearings 114 are attached to the extension 68.

When a feed line of the cylinder 100 is switched to exhaust, a spring 102 moves a piston 98 into a position 104 and releases the pin 108. Thus the part 92 is also released in the horizontal direction. However, when the cylinder 100 is supplied with pressure medium, the piston 98 moves into a position 112 and the pin 108 locks the part 92.

The second or auxiliary cylinder 22 is mounted upon the base plate 52 and is arranged relative to the mold half 18 on the side thereof opposite the side on which the main or first cylinder 20 is located. In a raised position 144 of its piston rod 142, a stroke 147 of a piston 140 is limited by a cylinder surface 146. In the lowered position depicted in FIG. 2, the piston rod 142 abuts the extension 68. Since the extensions 4,6 and 68 are constructed as a frame and since the piston rod 142 acts immediately beneath the frame 68, the force of the piston rod 142 will not cause deformation due to torsional forces during the process of separation of the mold halves 18 from the pattern device 16.

In the example described, the size of the cylinder 62 is selected in such a manner that the piston 60 may lift the parts that are connected thereto and also the mold box 24 and the mold half 18. On the other hand, the size of the cylinder 148 depends upon the size of the cylinder 62. The size of the cylinder 148 may be determined, by way of example, in accordance with rules of mechanics from the weights of the mold half 18, the mold box 24, the piston 60 and the parts 64,4, 6 or 68,8 connected to the latter, from the weight of the piston 140 including the piston rod 142 and from the friction of sand of the mold half 18 at the pattern device during separation. When reliable values for the forces necessary for overcoming friction of the sand at the patterns are not available, the size of the cylinder 148 may also be determined experimentally by inserting sleeves having bores of various diameters in the cylinder 148. In this connection, it should be taken into consideration that the product of lifting forces of the cylinder 62 minus the weight of the mold box 24 and minus the weight of the parts connected to the piston 60, multiplied by a distance a corresponds to the product of the lifting forces of the cylinder 148 multiplied by a distance b.

When a valve 152 is in appropriate position, a feed line 150 will supply pressure medium through a feed line 154 to the cylinder 148 and through a feed line 156 to the cylinder 62. By reversing the valve 152, the cylinders 148 and 62 will discharge through a discharge line 158. It is advantageous to adjust relative to each other the feed lines 154 and 156 as well as the flow conditions into the cylinders 148 and 62.

A description of the manner of operation of the apparatus of the present invention may commence from the assumption that a mold half 18 ready for lifting is in the position 12 and that a mold box 24 is in the position 30. Furthermore, the lifting and turning device 2 with open clamping devices 8 may be assumed to be in the lowered position in accordance with FIGS. 2 and 3. In this condition, the only forces acting upon the piston rod 64 result from the natural weights of the extensions 4,6 and of the clamping devices 8.

When the cylinder 94 is reversed, the clamping devices 8 of the extension 6 will grasp the mold box 24 and the clamping devices of the extension 4 will grasp the mold half 18. The parts 92 are locked since pressure medium is supplied to all cylinders 100. The piston rod 142 rests against the extension 4, 68. By reversing the valve 152 from the discharge position 158 to the feed line 152, the pressure medium will flow simultaneously and with equal pressure to the cylinders 62 and 148.

It is advantageous to control the beginning of the piston strokes 147, 145 by providing plugs 160 (see FIG. 2*a*) which project into the feed lines 154 or 156 or which are connected to a piston 140 or 60. While the mold half 19 performs a partial stroke which extends at least up to complete disengagement of a mold half 18 from the pattern device 16, the piston 140 continues to rest against the surface 46. The piston rod 142 concludes its stroke 147 in the raised position 144 and the cylinder 20 by itself raises the lifting and turning device 2 along the remaining path of the raised 149.

When the extension 4,6 is raised into the position 149, the lifting and turning device 2 is turned through half a turn in the direction of arrow 32 and is then lowered by reversing the valve 152. During the lowering process, the cylinders 100 of the extension 6 are switched to exhaust so that the grasped mold box 24 can be adjusted in a horizontal direction to the position of the dowel guide of the pattern device 16. By reversing the cylinder 94 the clamping devices 8 will be opened and by reversing the valve 152 the lifting and turning device 2 will be raised. Thus, the mold half 18 will have been lifted off the pattern device 16 and another mold box 24 may be placed on the pattern device 16.

It should be noted that cylinder means 20 and 22 are preferably of the same type and may either be of the hydraulic or pneumatic type. Consequently, feed line 150 will be connected to a corresponding source of either hydraulic or pneumatic pressure medium (not shown) depending on the type of cylinder means chosen. Preferably cylinders 94 and 100 are of the same type which is chosen for cylinder means 20 and 22 so that a common source of pressure medium may be used for the operation of all cylinders.

In any event, if heavy and large mold halves are to be produced the employment of hydraulic main and auxiliary cylinder means is preferred.

Utilization of the device of the present invention need not be limited to provision of a specific number of extensions 4,6,68 or to a particular number of clamping devices 8. Furthermore, the apparatus of the invention may be provided with more than one auxiliary or "second" cylinder 22.

While a specific embodiment of the invention has been shown and described in detail to illustrate the application of the inventive principles, it will be understood that the invention may be embodied otherwise without departing from such principles.

I claim:

1. A foundry molding machine for producing mold members in mold forming assemblies including a pattern device and mold boxes, said machine comprising means for separating said mold members from said pattern devices, said separating means including generally vertically extending main cylinder means having piston rod means operable to be raised and lowered by operation of said cylinder means, extension means connected to said piston rod means, clamping means including clamping levers on said extension means, said clamping levers being arranged in pairs to hold said molding boxes in clamping engagement, and at least one auxiliary cylinder means including piston means arranged in generally parallel relationship with said main cylinder means and located in laterally spaced relationship therewith in operative position on a side of said mold member opposite said main cylinder means, said auxiliary cylinder means being operatively associated with said main cylinder means and acting on said extension means to provide support during separation of said mold members from said pattern device.

2. A foundry molding machine according to claim 1 further including a joint pressure medium feed line which is controlled through a joint valve, said joint feed line being provided for both said main cylinder means and said auxiliary cylinder means.

3. A foundry molding machine according to claim 1 wherein said clamping means include two clamping devices each arranged on two oppositely located sides of said mold boxes, and wherein said extension means is constructed in the form of a frame.

4. A foundry molding machine according to claim 1 wherein said mold boxes include end faces of a part thereof, said part being constructed as a prismatic bar and wherein said clamping levers act on said end faces of said mold boxes.

5. In a foundry molding machine for producing mold members in mold forming assemblies including a pattern device and mold boxes, said machine including means for separating said mold members from said pattern devices, said separating means including generally vertically extending lifting cylinder means having piston means, extension means connected to said lifting cylinder means for movement between a lowered and raised position by operation of said cylinder means, clamping means including clamping levers on said extension means, said clamping levers being arranged in pairs to hold said molding boxes in clamping engagement, and control means to control the operation of said lifting cylinder means, the improvement which comprises at least one auxiliary cylinder means including piston means arranged in generally parallel and laterally spaced relationship with said lifting cylinder means and cooperating with said extension means in said lowered position on a side of said clamping means opposite said lifting cylinder means, said auxiliary cylinder means being actuable to exert an upwardly directed force upon said extension means and connecting means connecting said auxiliary cylinder means with said control means to thereby support said extension means during separation of said mold members from said pattern device upon operation of said lifting cylinder means.

6. A foundry molding machine for producing mold members in mold forming assemblies including a pattern device and mold boxes, said machine comprising means for separating said mold members from said pattern devices, said separating means including generally vertically extending main cylinder means having piston rod means operable to be raised and lowered by operation of said cylinder means, extension means connected to said piston rod means, clamping means including clamping levers on said extension means, said clamping levers being arranged in pairs to hold said molding boxes in clamping engagement, and at least one auxiliary cylinder means including piston means arranged in generally parallel relationship with said main cylinder means and located in laterally spaced relationship therewith in operative position on the side of said mold member opposite said main cylinder means, said auxiliary cylinder means being operatively associated with said main cylinder means and acting on said extension means to provide support during separation of said mold members from said pattern device, said main and auxiliary cylinder means each operating through an operating stroke having a given height, with the height of the stroke of said auxiliary cylinder means being smaller than that of said main cylinder means.

* * * * *